United States Patent [19]

Bonde

[11] Patent Number: 4,926,813

[45] Date of Patent: May 22, 1990

[54] INVERTED PORT ENGINE WITH CROSS-UNDER INTAKE PASSAGE

[75] Inventor: Kevin G. Bonde, Kiel, Wis.

[73] Assignee: Tecumseh Products Company, Tecumseh, Mich.

[21] Appl. No.: 378,808

[22] Filed: Jul. 12, 1989

[51] Int. Cl.[5] ..... F02M 35/10

[52] U.S. Cl. ..... 123/195 HC; 123/52 M; 123/193 C

[58] Field of Search ..... 123/195 HC, 52 MC, 52 M, 123/193 C

[56] References Cited

U.S. PATENT DOCUMENTS

| | | | |
|---|---|---|---|
| 1,178,972 | 4/1916 | Tracy . | |
| 1,434,069 | 10/1922 | Sfetescu . | |
| 1,539,963 | 6/1925 | Sherbondy . | |
| 3,118,433 | 1/1964 | Lechtenberg . | |
| 3,194,224 | 7/1965 | Lechtenberg et al. . | |
| 3,916,847 | 11/1975 | Nakano et al. . | |
| 4,368,698 | 1/1983 | Matsuo et al. | 123/52 M |
| 4,570,587 | 2/1986 | Watanabe et al. | 123/195 HC |
| 4,789,004 | 12/1988 | McCracken | 123/52 M |
| 4,790,273 | 12/1988 | Oguri et al. | 123/195 HC |
| 4,819,589 | 4/1989 | Nagashima | 123/52 M |

*Primary Examiner*—Willis R. Wolfe
*Assistant Examiner*—M. Macy
*Attorney, Agent, or Firm*—Jeffers, Hoffman & Niewyk

[57] ABSTRACT

The present invention is an inverted port L-head engine having a cross-under intake passage. The carburetor and exhaust system are disposed on opposite sides of the cylinder, and the exhaust valve is located over the intake valve on the exhaust side. The cast cylinder has openings for receiving ends of a cross-under tube which provides an intake passage from the carburetor to the intake valve. The U-shaped cross-under tube extends under the piston bore and is slidably received in the cylinder block openings. Sealant may be used to form airtight seals between the tube ends and the cylinder openings.

16 Claims, 2 Drawing Sheets

INVERTED PORT ENGINE WITH CROSS-UNDER INTAKE PASSAGE

BACKGROUND

The field of the invention is that of L-head internal combustion engines. More particularly, the invention relates to L-head internal combustion engines having a cast cylinder assembly and an intake cross-under passage.

One arrangement of a prior art L-head internal combustion engine, which is sometimes referred to as a side valve engine, comprises a crankshaft disposed vertically which reciprocates with a horizontally disposed piston. The cylinder includes intake and exhaust valve cavities located relatively closely on one side of the cylinder, with the intake valve positioned above the exhaust valve. The valves have a parallel orientation relative to the piston bore, with their heads and seats located near the head of the cylinder in communication with the piston bore and the spark plug. The intake valve periodically opens to create a passageway connecting a carburetor and the piston bore, with the passageway including the intake cavity near the cylinder head. Similarly, the exhaust valve periodically opens a passageway connecting the piston bore and an exhaust system, which includes a muffler, with the passageway including an exhaust cavity near the cylinder head. A common camshaft located within the crankcase lifts and opens the valves.

Although the intake and exhaust valves are disposed on a common side of the cylinder, locating the carburetor and the exhaust system on opposite sides of the engine provides a number of benefits. One benefit is that the carburetor is not exposed to the exhaust heat from the exhaust system, which minimizes negative consequences which result when the carburetor is excessively heated. Another benefit relates to separating the carburetor fuel lines from the muffler to avoid the potential hazard from having the fuel too close to a heat source.

To achieve these and other benefits, prior art engines route an external intake tube from the intake value, over the cylinder, to the carburetor located on the opposite side. Locating the intake valve above the exhaust valve results in less efficient cooling of the exhaust because the exhaust cavity is less exposed to the flow of cooling air which circulates more about the upper sections of the engine. In addition, the intake system insulates the exhaust system, inhibiting the dissipation of heat because the rising heat from the exhaust system is trapped by the components of the intake system. Further, routing the intake tube over the cylinder requires that the carburetor be mounted relatively high with respect to the mounting of the engine. This restricts the space available above the carburetor to accommodate a gravity feed fuel tank, constraining the volume of the tank if the height of the engine is unchanged. Alternatively, a larger fuel tank can be provided, but that requires the undesirable result of increasing the height of the engine.

A solution of the aforementioned problems involves routing the intake passageway, formed within the cylinder block, under the cylinder, as disclosed in the copending application entitled "Engine Cylinder Assembly Having An Intake Cross-Passageway", Ser. No. 342,186, filed Apr. 24, 1989, now U.S. Pat. No. 4,893,597. This arrangement allows for better ventilation for the exhaust system while not restricting the space available for a fuel tank. However, providing an integrally formed intake passageway within the cylinder entails extra manufacturing steps and cost. Also, the intake system buried within the block absorbs heat from the block, reducing the overall volumetric efficiency.

What is needed in the art is an engine that realizes the advantages of a cross-under intake passageway underneath the cylinder while a minimizing the cost and without absorbing the excess heat which reduces the efficiency.

SUMMARY OF THE INVENTION

The present invention is an inverted port L-head engine having a carburetor opposite the exhaust side of a cylinder, with a cross-under tube providing an intake passage which connects the carburetor to the intake valve. The cast cylinder has the intake valve positioned below the exhaust valve, with openings in the cast cylinder for receiving ends of the cross-under tube. One opening is located near the intake valve, with the other opening is disposed on the other side near a carburetor mounting port block. The openings and the mounting port block are die cast in the cylinder.

The present invention achieves simplicity and economy by minimizing the number of parts rquired to provide a cross-under intake passageway, in that only the single cross-under tube is needed to provide an airtight passage from the carburetor to the cylinder. No O-rings, gaskets, mounting screws, or other additional parts are involved in connecting the cross-under tube to the cylinder blocks, rather an interference fit secures the tube within the openings of the cast cylinder. Alternately, a single mounting screw can be used to mechanically fasten the tube to the cylinder. Assembling the engine is quick and easy as the only step necessary to attach the cross-under tube is to insert the tube ends into the cast cylinder's openings. Preferably, a liquid sealant can be used to provide a seal to insure the passageway is airtight.

In addition, the carburetor is more securely attached to the engine of the present invention. In some prior art engines, the carburetors are positioned somewhat independently of the cylinder when a separate tube connects the two. Thus, the carburetor is subject to being moved in its position relative to the cylinder, changing the shape and/or size of the intake passageway resulting in a diminished performance. A carburetor mounting port block integrally formed within one side of the cast cylinder so that the mounting is rigid and requires no gauging to mount the carburetor. Such a stable mounting surface provides accurate location for attaching the carburetor, to improve the efficiency and stability of the intake side of the cylinder.

The aerodynamically smooth shape of the cross-under tube also improves the efficiency of the engine. Although the cross-under tube extends around the cylinder, it has gentle bends which induce a more laminar flow of combustion fluids to the intake valve. By providing such an intake passageway, turbulence is minimized and the breathing of the engine is improved thus making the engine more efficient.

The present invention, in one form thereof, comprises a vertical shaft internal combustion engine having a carburetor, an exhaust system, and a cylinder assembly. The cylinder assembly includes a cylinder block comprising a cylinder with a piston bore, an intake cavity and valve, and an exhaust cavity and valve. The exhaust cavity has an exhaust port and is located proximate to and above the intake valve cavity on a first side of the cylinder. Also on the cylinder is a downwardly facing first opening located below the intake valve cavity on the first side, a downwardly facing second opening located on the second side, and a carburetor port is also located on the second side. The first opening is in communication with and located near the intake cavity, and the second opening is in communication with the carburetor port. Connected to the cylinder block is a cross-under tube which has a first end and a second end received in the cylinder block. The cross-under tube has a U-shaped and its first and second ends are relatively parallel, with the first end and the second end of the cross-under tube being slidably received in the first and second openings, respectively, of the cylinder. Further, the cross-under tube is connected and sealed to the cylinder block so that they provide an intake passage from the carburetor port to the intake valve cavity. The carburetor is disposed on the second side and is connected to the carburetor port, while the exhaust system is disposed on the first side and is connected to the exhaust port.

One object of the present invention is to provide a cylinder assembly which is both simple to construct and economically efficient. Another object of the present invention is to provide an improved design for an inverted port engine.

BRIEF DESCRIPTION OF THE DRAWINGS

The above mentioned and other features and objects of this invention, and the manner of attaining them, will become more apparent and the invention itself will be better understood by reference to the following description of and embodiment of the invention taken in conjunction with the accompanying drawings, wherein.

Figure 1:
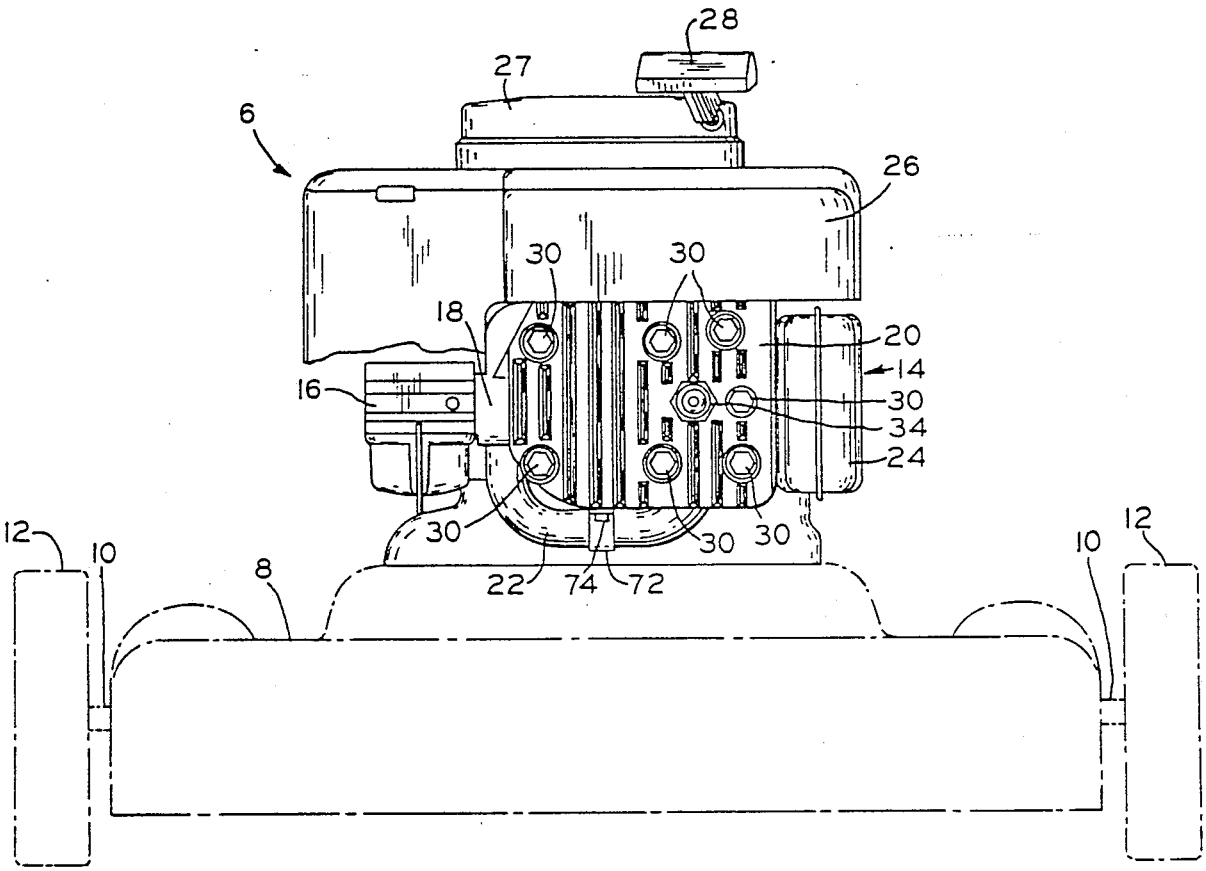
FIG. 1 is a front elevational view of a lawn mower having an engine of the present invention.

Corresponding reference characters indicate corresponding parts throughout the several views. The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

The present invention is a cylinder assembly for an inverted port L-head internal combustion engine. It is used, for example as in FIG. 1, to drive a cutting blade (not shown) of a lawn mower 6. Lawn mower 6 comprises a deck 8 convering the blade and having axles 10 rotatably connected with wheels 12; the axles 10 extending from sides near the bottom of deck 8. Mounted on deck 8 is L-head engine 14, which comprises a carburetor 16, a cylinder block 18, a cylinder head 20, a cross-under tube 22, and an exhaust system 24. Above those components of engine 14 are blower housing 26, a gravity feed fuel tank (not shown), above which is starter housing 27 from which extends pull handle 28 attached to a flywheel pulley (not shown). The remaining components of engine 14 (e.g. vertical crankshaft and camshaft, crankcase, piston, etc.) are well known and consequently are omitted for the sake of clarity in the following description.

Figure 2:
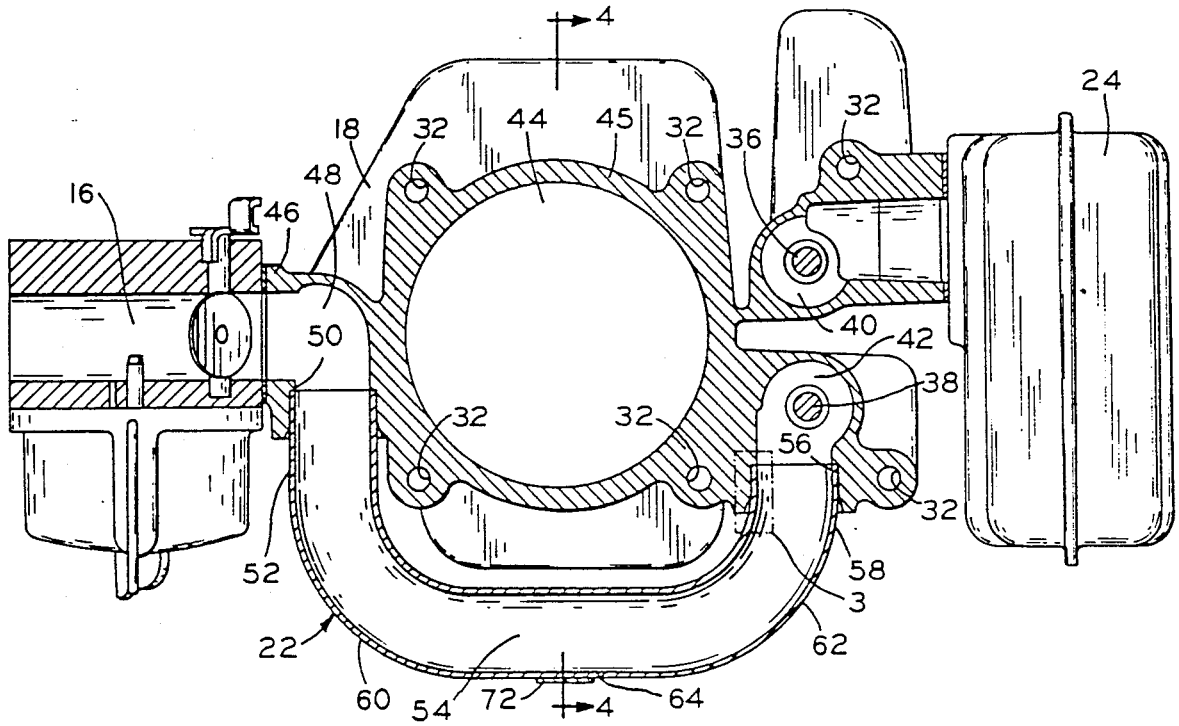
FIG. 2 is a front sectional view of the engine of the present invention.

Cylinder head 20 covers much of the front of cylinder block 18, and is connected by head bolts 30 which are received in bolt holes 32 of cylinder block 18 (see FIG. 2). Also, spark plug 34 is positioned so that it extends through cylinder head 20, and operates in a known manner.

Referring to FIG. 2, the configuration of exhaust valve 36 above intake valve 38 causes L-head engine 14 to be termed an "inverted port" engine, as opposed to engines which have the intake valve over the exhaust valve. When closed, exhaust valve 36 and cylinder block 18 define exhaust cavity 40, and intake valve 38 and cylinder block 18 define intake cavity 42. Valves 36 and 38 open alternately, with an open exhaust valve 36 allowing products of combustion to exit from a combustion chamber (not shown) above piston bore 44 of cylinder 45, and an open intake valve 38 allowing a combustion mix to enter the combustion chamber and piston bore 44. The exiting products of combustion flow past valve 36, through the exhaust cavity 40, to the attached exhaust system 24 which comprises a muffler and, if needed, associated piping. The intake combustion mix is drawn from carburetor 16 through intake cavity 42, past valve 38, and into the combustion chamber.

The present invention concerns a novel arrangement for providing an air/fuel combustion mix from carburetor 16 to cylinder block 18. Integrally formed within cylinder block 18 is a carburetor port block 46 which provides a rigid, accurate support for directly mounting carburetor 16, and associated intake system components, to cylinder block 18. Carburetor port block 46 is located on a side of cylinder block 18 opposite valves 36 and 38, and includes intake chamber 48. In communication with intake chamber 48, an opening 50 is integrally formed within cylinder block 18, preferably by machining, to receive end 52 of cross-under tube 22. End 52 slidably engages opening 50, preferably forming an interference fit within opening 50.

Passage 54, defined by inner walls of cross-under tube 22, provides fluid communication between carburetor 16 and intake valve 38; cross-under tube 22, hence passage 54, extends under cylinder block 18. Opening 56, which is integrally formed within cylinder block 18 and in communication with intake cavity 42, receives end 58 of cross-under tube 22 to complete passage 54. Preferably, opening 56 is machined in cylinder block 18 and engages end 58 to form an interference fit.

Cross-under tube 22 is U-shaped and has an aerodynamic contour which facilitates providing a continuous, uniform flow of air/fuel combustion mix, thus improving the efficiency of the engine. Ends 52 and 58 are vertical and mutually parallel, with both extending downwardly to form bends 60 and 62, respectively. The bends are not sharp right hand angles that tend to cause turbulence. Rather, bends 60 and 62 have a generally curvilinear shape both of which eventually straighten to form straight section 64 of cross-under tube 22. This curvillinear shape promotes laminar flow within cross-under tube 22, eliminating much of the turbulence which interferes with the flow of a combustion mixture within passage 54 thus increasing the efficiency of engine 14.

To build L-head engine 14, carburetor 16, cylinder block 18, cylinder head 20, exhaust system 24, etc., are assembled in a conventional manner. to connect cross-under tube 22 to cylinder block 18, end 52 is positioned in opening 50 and end 58 is positioned in opening 56. The straight section 64 of cross-under tube 22 is then pushed upwardly to force ends 52 and 58 deeper into their respective openings 50 and 56. The U-shaped contour of cross-under tube 22 facilitates its assembly because with the parallel ends 52 and 58, a single push in the axial direction of ends 52 and 58 slip of the cross-under tube 22 securely in place. In the preferred embodiment, cross-under tube 22 comprises bent steel tubing; alternately, cross-under tube 22 can be of plastic construction, either blow molded or injection molded using a metal core that melts out at relatively low temperatures. The resiliency of ends 52 and 58 of cross-under tube 22 and the structure forming openings 50 and 56 enable the interference fit to be formed.

Figure 3:
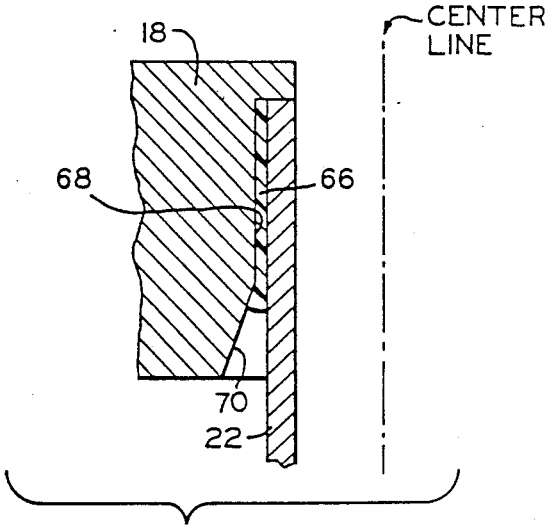
FIG. 3 is an enlarged sectional view of the outlined area 3 of FIG. 2.

Referring to FIG. 3, a preferred technique for sealing cross-under tube 22 to openings 50 and 56 is shown. A liquid sealant 66, which ensures an airtight sealing of passage 54, is placed on ends 52 and 58 of cross-under tube 22, or receiving walls 68 of cylinder block 18, to seal and hold cross-under tube 22 in place. A tapered region 70 in receiving wall 68 provides space for excess sealant 66 and assists in guiding cross-under tube 22 in place. The sealant is preferably a low viscosity anaerobic type which will penetrate the joint and form a seal in the absence of air, but other types of sealants, such as silicone based caulk, can be used.

Figure 4:
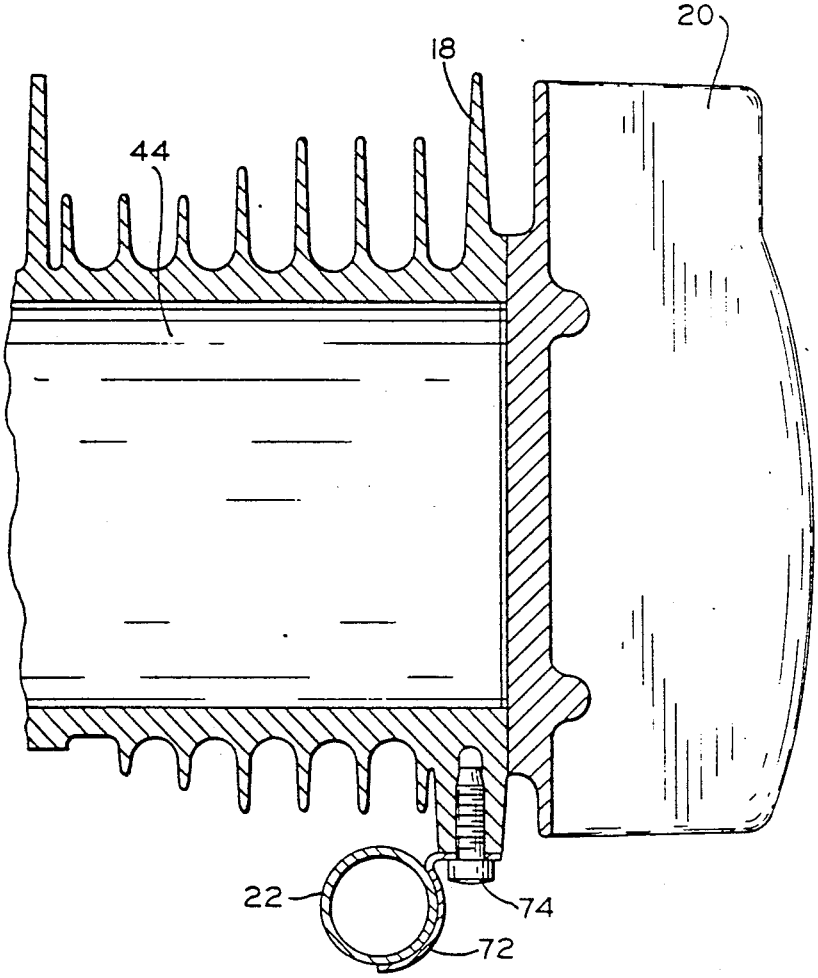
FIG. 4 is a sectional view taken along view line 4—4 of FIG. 2 in the direction of the arrows.

Referring to FIG. 4, a bracket 72 is provided to position and retain cross-under tube 22 properly. Bracket 72 is mounted on cylinder block 18 by screw 74 below piston bore 44 after attaching cross-under tube 22 to cylinder block 18. Bracket 72 provides an additional (or possibly alternate) structure for retaining cross-under tube 22, as a single fastener can be used when the amount of interference alone is insufficient to retain tube 22 securely.

Alternate means can be used to ensure the retention of tube 22 to block 18. For example, tube 22 can be press fit into openings 50 and 56. Also, a single screw or a press fit/screw combination can provide an adequate connection, preferably in combination with a bracket. Additionally, a combination adhesive/sealant, such as high temperature epoxy, can be utilized. Further, soldering or brazing can provide a connection for tube 22.

While this invention has been described as having a preferred design, it can be further modified within the teachings of this disclosure. This application is therefore intended to cover any variations, uses, or adaptations of the invention following its general principles. This application is also intended to cover departures from the present disclosure as come within known or customary practice in the art to which this invention pertains and fall within the limits of the appended claims.

What is claimed is:

1. In a vertical shaft internal combustion engine having a carburetor and an exhaust system, a cylinder assembly comprising:

a cylinder block comprising a cylinder including a piston bore, an intake cavity for receipt of an intake valve, an exhaust cavity for receipt of an exhaust valve, said exhaust cavity having an exhaust port therein, said exhaust cavity located proximate and have said intake cavity on a first side of said cylinder, a downwardly facing first opening located below said intake cavity on said first side, a downwardly facing second opening located on a second side, and a carburetor port located on said second side, said first opening being in communication with and near said intake cavity, said second opening being in communication with said carburetor port;

a cross-under tube connected to said cylinder block, said cross-under tube having a first end and a second end received in said cylinder block, said cross-under tube being U-shaped with said first and second ends being relatively parallel, said first end and said second end of said cross-under tube being slidably received in said first opening and said second opening, respectively, of said cylinder; and means for connecting and sealing said cross-under tube to said cylinder block such that said cross-uner tube and said cylinder block provide an intake passage from said carburetor port to said intake cavity;

said carburetor disposed on said second side and connected to said carburetor port, said exhaust system being disposed on said first side and connected to said exhaust port.

2. The cylinder assembly of claim 1 wherein said cross-under tube is located under said cylinder block and said piston bore.

3. The cylinder assembly of claim 1 wherein said means for connecting and sealing said cross-under tube and said cylinder comprises an interference fit.

4. The cylinder assembly of claim 1 wherein said means for connecting and sealing said cross-under tube said cylinder comprises a sealant disposed between said first and second ends of said tube and said first and second openings, respectively.

5. The cylinder assembly of claim 1 wherein said first and said second openings include a tapered region.

6. The cylinder assembly of claim 1 wherein said cross-under tube comprises metal.

7. The cylinder assembly of claim 1 wherein said cross-under tube comprises plastic.

8. The cylinder assembly of claim 1 wherein said cross-under tube has a smooth aerodynamic shape without sharp bends for promoting laminar flow through said intake passage.

9. The cylinder assembly of claim 1 further comprising a bracket mounted on the underside of said cylinder to position and retain said cross-under tube.

10. An L-head type vertical crankshaft, single cylinder internal combustion engine comprising:

a cylinder block comprising a cylinder having a horizontal bore for receiving a piston, an exhaust cavity for receiving an exhaust valve located on a first side of said cylinder, an intake cavity for receiving an intake valve located on said first side disposed under said exhaust cavity, a first opening disposed under and in communication with said intake cavity, an exhaust port on said first side, a carburetor port on a second side opposite said first side, and a second opening on said second side in communication with said carburetor port;

an exhaust system, including a muffler, connected to said cylinder at said exhaust port on said first side;

a carburetor connected to said cylinder at said carburetor port on said second side;

a cross-under tube located under said cylinder and said piston bore, said cross-under tube comprising a first end slidably received in said first opening, a first bend connected to said first end and to a straight section of said cross-under tube, and a second bend connected to said straight section and to a second end slidably received in said second opening of said cylinder; and means for connecting and sealing said cross-under tube to said first and second openings of said cylinder such that said cross-under tube provides a passage from said carburetor to said intake cavity.

11. The engine of claim 10 wherein said means for connecting said cross-under tube and said cylinder comprises an interference fit.

12. The engine of claim 10 wherein said cross-under tube comprises meal.

13. The engine of claim 10 wherein said cross-under tube comprises plastic.

14. The engine of claim 10 wherein said means for connecting said cross-under tube and said cylinder comprises a sealant disposed within said first and second openings.

15. The engine of claim 10 wherein said first and said second openings include a tapered region.

16. The engine of claim 10 wherein said first and second bends have a gentle curvilinear shape promoting laminar flow through said passage.

* * * * *